US011719408B2

(12) United States Patent
Honmiya et al.

(10) Patent No.: US 11,719,408 B2
(45) Date of Patent: Aug. 8, 2023

(54) VEHICLE HEADLAMP

(71) Applicant: KOITO MANUFACTURING CO., LTD., Tokyo (JP)

(72) Inventors: Taishi Honmiya, Shizuoka (JP); Yusuke Mochizuki, Shizuoka (JP); Akinori Matsumoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/788,449

(22) PCT Filed: Dec. 7, 2020

(86) PCT No.: PCT/JP2020/045470
§ 371 (c)(1),
(2) Date: Jun. 23, 2022

(87) PCT Pub. No.: WO2021/131639
PCT Pub. Date: Jul. 1, 2021

(65) Prior Publication Data

US 2023/0046360 A1 Feb. 16, 2023

(30) Foreign Application Priority Data

Dec. 27, 2019 (JP) ..... 2019-238794
Dec. 27, 2019 (JP) ..... 2019-238795

(51) Int. Cl.
*F21S 41/43* (2018.01)
*F21S 41/33* (2018.01)
(Continued)

(52) U.S. Cl.
CPC ..... *F21S 41/43* (2018.01); *F21S 41/141* (2018.01); *F21S 41/25* (2018.01); *F21S 41/33* (2018.01);
(Continued)

(58) Field of Classification Search
CPC .. F21S 41/25; F21S 41/33; F21S 41/43; F21S 41/141; F21W 2102/155; F21Y 2115/10
See application file for complete search history.

(56) References Cited

U.S. PATENT DOCUMENTS

2011/0261576 A1* 10/2011 Uchida ..... F21S 41/365 362/512

FOREIGN PATENT DOCUMENTS

| | | | |
|---|---|---|---|
| JP | 2007-179994 | A | 7/2007 |
| JP | 2011-258485 | A | 12/2011 |
| JP | 2018-049730 | A | 3/2018 |

OTHER PUBLICATIONS

International Search Report dated Jan. 19, 2021 for WO 2021/131639 A1 (4 pages).

* cited by examiner

*Primary Examiner* — Thomas M Sember
(74) *Attorney, Agent, or Firm* — Venjuris, P.C.

(57) ABSTRACT

A vehicle headlamp includes a shade that shields a part of light emitted from a light source. A predetermined end edge of the shade serves as a cut line forming portion that forms a cut line of a light distribution pattern and the shade is provided with a dimming portion positioned behind the cut line forming portion. The cut line forming portion and the dimming portion form a low-brightness portion having a lower brightness than that of other portions in a part of the light distribution pattern. A portion of the shade including the cut line forming portion is provided as a flat plate-shaped functional surface portion and at least the functional surface portion is tilted backward and downward.

11 Claims, 9 Drawing Sheets

(51) Int. Cl.

| | |
|---|---|
| ***F21S 41/25*** | (2018.01) |
| ***F21S 41/141*** | (2018.01) |
| ***F21Y 115/10*** | (2016.01) |
| ***F21W 102/155*** | (2018.01) |

(52) U.S. Cl.
CPC .... *F21W 2102/155* (2018.01); *F21Y 2115/10* (2016.08)

VEHICLE HEADLAMP

CROSS REFERENCE TO RELATED APPLICATIONS

This application is a national phase of PCT application No. PCT/JP2020/045470, filed on 7 Dec. 2020, which claims priority from Japanese patent application Nos. 2019-238794 and 2019-238795, filed on 27 Dec. 2019, all of which are incorporated herein by reference.

TECHNICAL FIELD

The present disclosure relates to a technical field of a vehicle headlamp including a shade that shields a part of light emitted from a light source.

BACKGROUND

There is a vehicle headlamp in which, for example, a shade that shields a light source that emits light or a part of the light emitted from the light source is disposed inside a lamp case constituted by a cover and a lamp housing (see, e.g., Patent Document 1 and Patent Document 2).

In the vehicle headlamps disclosed in Patent Document 1 and Patent Document 2, a lamp unit having a light source, a shade, a reflector, and a projection lens is disposed inside a lamp case, and the light emitted from the light source is reflected by the reflector, converted into a substantially parallel light by the projection lens, transmitted through the cover, and irradiated to the front. At this time, a part of the light reflected by the reflector is shielded by the shade, and a light distribution pattern is formed by the light that is not shielded by the shade.

A predetermined end edge of the shade is formed as a cut line forming portion, and a cut line of the light distribution pattern is formed by the cut line forming portion.

Further, a low-brightness portion having a lower brightness than that of the other portion may be formed in the light distribution pattern. In this case, the light emitted from the light source is controlled by a dimming portion positioned behind the cut line forming portion and the cut line forming portion so as to form the low-brightness portion. By forming the low-brightness portion in the light distribution pattern, the generation of dazzling light (glare light) to passengers of a preceding vehicle or an oncoming vehicle is suppressed.

The shade is mainly made of a metal material, and at least a part of the cut line forming portion is formed by bending a part of the metal material so as to satisfy a predetermined condition for forming the light distribution pattern and the low-brightness portion.

PRIOR ART DOCUMENT

Patent Document

Patent Document 1: Japanese Patent Laid-Open Publication No. 2018-049730

Patent Document 2: Japanese Patent Laid-Open Publication No. 2011-258485

SUMMARY OF THE INVENTION

Problem to be Solved

However, when at least a part of the cur line forming portion is formed by bending a part of the metal material as described above, the positional accuracy of the cut line forming portion with respect to the entire shade may be deteriorated due to the bending processing, and the bending processing is required at the time of manufacturing the shade, which increases the manufacturing cost of the vehicle headlamp.

Therefore, a vehicle headlamp according to the present disclosure is to secure a high positional accuracy of a cut line forming portion with respect to an entire shade and to promote a decrease of a manufacturing cost.

Means to Solve the Problem

Firstly, a vehicle headlamp according to the present disclosure includes a shade that shields a part of light emitted from a light source. A predetermined end edge of the shade serves as a cut line forming portion that forms a cut line of a light distribution pattern. The shade is provided with a dimming portion positioned behind the cut line forming portion. The cut line forming portion and the dimming portion form a low-brightness portion having a lower brightness than that of other portions in a part of the light distribution pattern. A portion of the shade including the cut line forming portion is provided as a functional surface portion having a flat plate shape. At least the functional surface portion is tilted backward and downward.

As a result, since the flat plate-shaped functional surface portion including the cut line forming portion is tilted backward and downward, the cut line of the light distribution pattern is formed by the cut line forming portion and the low-brightness portion is formed in the light distribution pattern by the dimming portion and the cut line forming portion.

Secondly, in the vehicle headlamp according to the present disclosure, the dimming portion may be formed in a flat plate shape.

As a result, the low-brightness portion is formed in the light distribution pattern by the flat plate-shaped dimming portion.

Thirdly, in the vehicle headlamp according to the present disclosure, the shade may be constituted by a base member including the functional surface portion and a plate-shaped member including the dimming portion and attached to the base member.

As a result, the shade is constituted by the two members of the base member and the plate-shaped member.

Fourthly, in the vehicle headlamp according to the present disclosure, the base member may be provided with a base surface portion that is bent with respect to the functional surface portion, and the plate-shaped member may be attached to the base surface portion.

As a result, the plate-shaped member including the dimming portion is attached to the base surface portion integrally formed with the functional surface portion including the cut line forming portion and provided continuously with the functional surface portion.

Fifthly, in the vehicle headlamp according to the present disclosure, at least a part of the functional surface portion may be formed as a reflective surface that reflects the light emitted from the light source, and the light reflected by the reflective surface may be used as a part of light that forms a light distribution pattern.

As a result, at least a part of the functional surface portion serves as the reflective surface that reflects light that forms the light distribution pattern.

Sixthly, another vehicle headlamp according to the present disclosure includes a shade that shields a part of light emitted from a light source. A predetermined end edge of the shade serves as a cut line forming portion that forms a cut line of a light distribution pattern. The shade is provided with a dimming portion that forms a low-brightness portion having a lower brightness than that of other portions in a part of the light distribution pattern. A lower surface of the dimming portion is positioned above an upper end of the cut line forming portion.

As a result, the dimming portion is positioned above the cut line forming portion with a gap therebetween.

Seventhly, in another vehicle headlamp according to the present disclosure, a portion of the shade including the cut line forming portion may be provided as a functional surface portion having a flat plate shape, the shade may be provided with a connecting portion having one end continuous with the functional surface portion, the dimming portion may be continuously provided at the other end of the connecting portion, and the connecting portion may be formed in a shape protruding from the functional surface portion.

As a result, the position of the dimming portion with respect to the cut line forming portion is determined according to the protruding amount and the protruding direction of the connecting portion with respect to the functional surface portion including the cut line forming portion.

Eighthly, in the vehicle headlamp according to the present disclosure, the dimming portion may be formed by being bent with respect to the connecting portion.

As a result, the direction of the dimming portion with respect to the cut line forming portion is determined according to the bending angle of the dimming portion with respect to the connecting portion.

Ninthly, in the vehicle headlamp according to the present disclosure, the functional surface portion may be formed in a folded shape, portions on both sides of the folded portion of the functional surface portion may be provided as a first portion and a second portion, respectively, the first portion and the second portion may be in contact with each other in a thickness direction, the cut line forming portion may be formed in the first portion, and the connecting portion may protrude from the second portion.

As a result, since the first portion including the cut line forming portion and the second portion from which the connecting portion protrudes are in contact with each other in the thickness direction, the positional accuracy of the connecting portion with respect to the cut line forming portion is increased.

Tenthly, in the vehicle headlamp according to the present disclosure, the functional surface portion, the connecting portion, and the dimming portion may be integrally formed.

As a result, the functional surface portion, the connecting portion, and the dimming portion may be formed by one member.

Effect of the Invention

According to the present disclosure, the flat plate-shaped functional surface portion including the cut line forming portion is tilted backward and downward, and thus, the cut line of the light distribution pattern is formed by the cut line forming portion and the low-brightness portion is formed in the light distribution pattern by the dimming portion and the cut line forming portion. Therefore, the bending processing for forming the cut line forming portion is not required at the manufacturing of the shade, and it is possible to secure a high positional accuracy of the cut line forming portion with respect to the entire shade and to promote a decrease of the manufacturing cost of the vehicle headlamp.

Detailed Description to Execute the Invention

Hereinafter, an embodiment for implementing a vehicle headlamp of the present disclosure will be described with reference to the accompanying drawings.

Vehicle Headlamp According to First Embodiment

First, a vehicle headlamp 1 according to a first embodiment will be described (see FIGS. 1 to 5).

The vehicle headlamp 1 is disposed on each of left and right ends of the front end portion of a vehicle.

Figure 1:
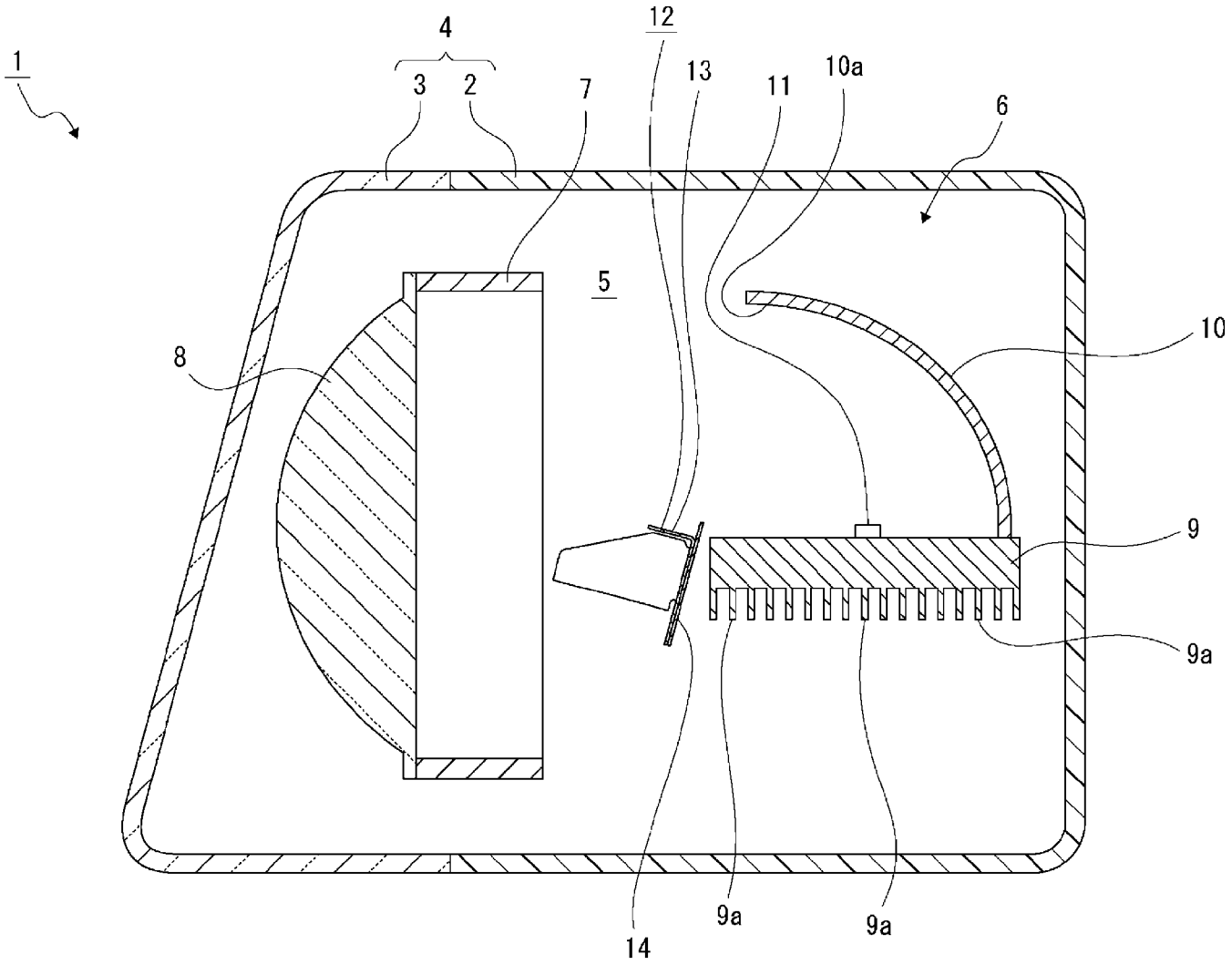
FIG. 1 illustrates an embodiment of a vehicle headlamp of the present disclosure together with FIGS. 2 to 5, and is a schematic cross-sectional view of the vehicle headlamp.

The vehicle headlamp 1 includes a lamp housing 2 that is opened frontward and a cover 3 that closes an opening surface of the lamp housing 2 (see FIG. 1). A lamp case 4 is constituted by the lamp housing 2 and the cover 3, and the internal space of the lamp case 4 is formed as a lamp chamber 5.

A lamp unit 6 is disposed in the lamp chamber 5. The lamp unit 6 includes a lens holder 7 formed in a cylindrical shape, a projection lens 8 attached to a front end portion of the lens holder 7, a heat dissipation base 9 disposed behind the lens holder 7, a reflector attached to the heat dissipation base 9 with a lower end portion, a light source 11 disposed on the heat dissipation base 9, and a shade 12 that shields a part of light emitted from the light source 11.

The lamp unit 6 is supported by the lamp housing 2 via an optical axis adjusting mechanism (not illustrated). Therefore, it is possible to adjust the optical axis of light emitted from the light source 11 by operating the optical axis adjusting mechanism to move the lamp unit 6 in the vertical direction or the left-right direction with respect to the lamp housing 2.

A surface of the projection lens 8 on the front side is formed as a convex surface and a surface on the rear side is formed as a flat surface facing the rear. The projection lens 8 has a function of inverting an image on a focal plane including a rear focal point and projecting the image forward.

The heat dissipation base 9 includes a plurality of heat dissipation fins 9*a*, 9*a*, . . . . Therefore, the heat generated when the light source 11 is driven is mainly released from the heat dissipation fins 9*a*, 9*a*, . . . , and a good driving state of the light source 11 is secured.

An inner surface of the reflector 10 is formed as a reflective surface 10*a*, and the reflective surface 10a is formed, for example, in an elliptical spherical surface. The reflector 10 is disposed in a direction in which one focal point of the reflector 10*a* coincides with the light source 11 and the other focal point of the reflector 10*a* coincides with the rear focal point of the projection lens 8.

As the light source 11, for example, a light emitting diode (LED) is used.

The shade 12 is, for example, a fixed shade, and is attached to a part of the lamp unit 6, for example, an attaching member such as a bracket (not illustrated). However, the shade 12 may be provided as a movable shade.

Figure 2:
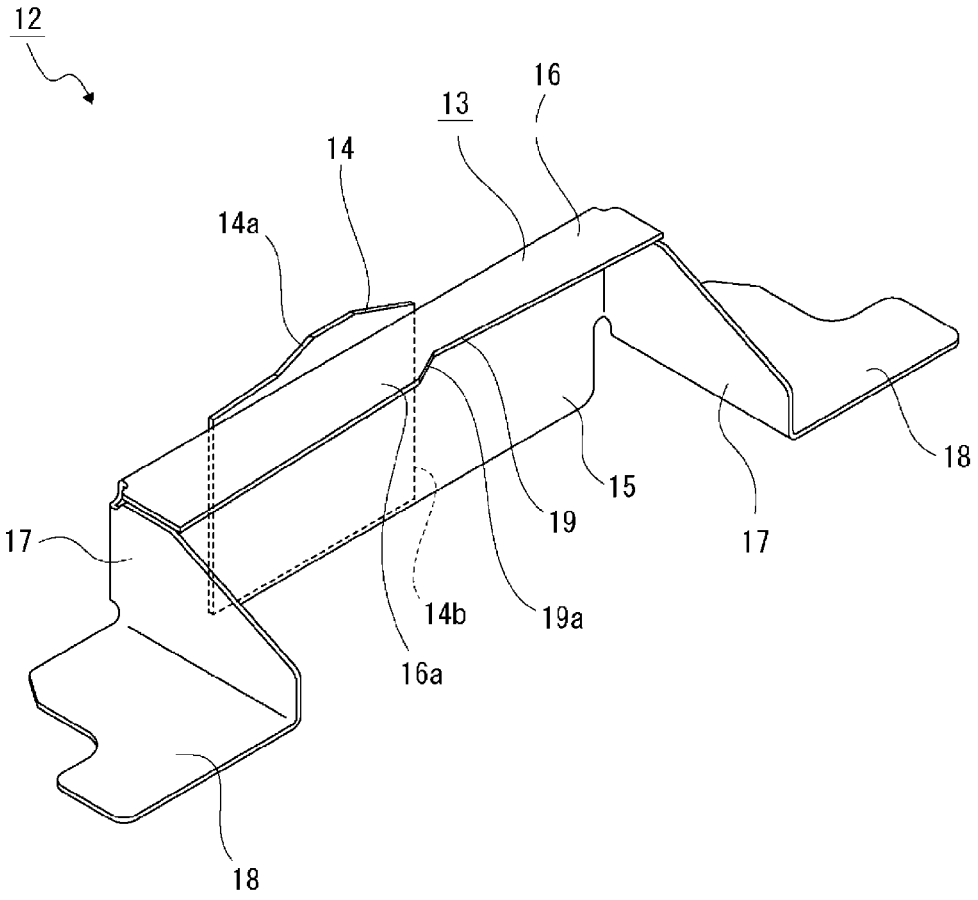
FIG. 2 is a perspective view of a shade.
Figure 3:
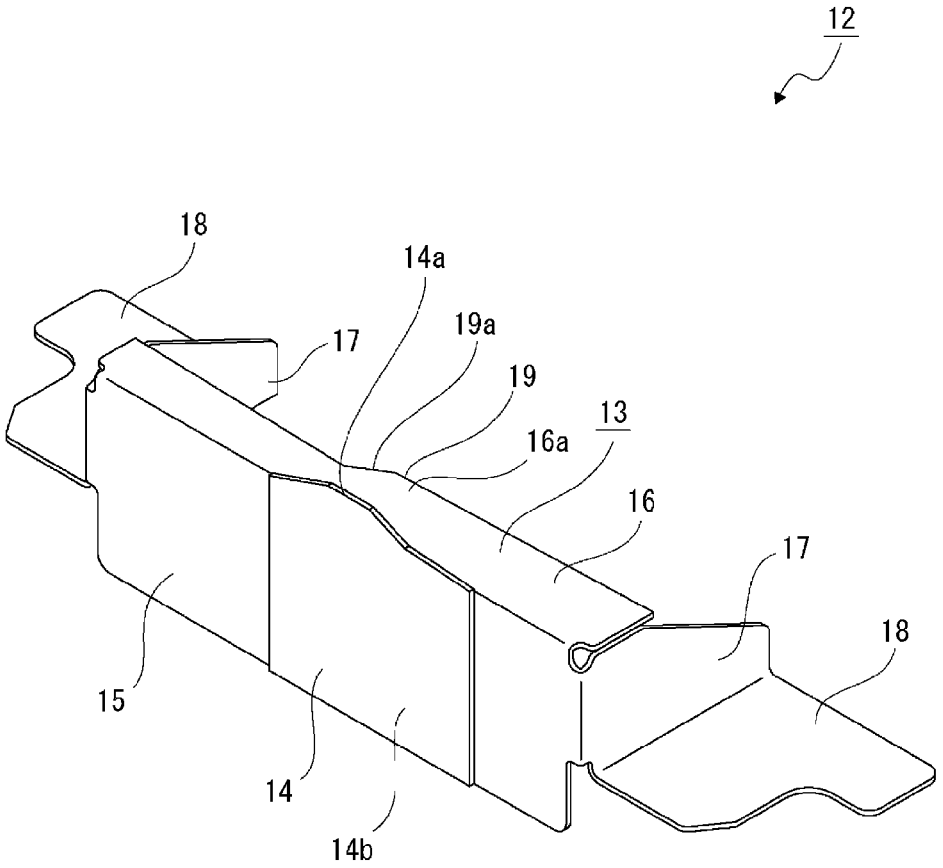
FIG. 3 is a perspective view illustrating the shade when viewed from a direction different from that in FIG. 2.
Figure 4:
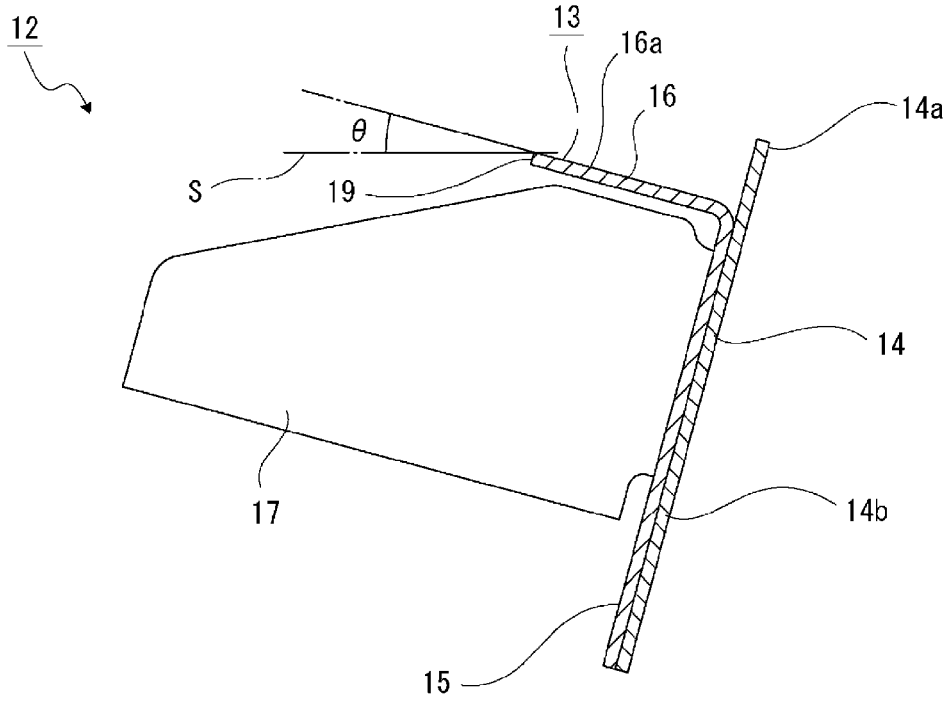
FIG. 4 is a vertical cross-sectional view of the shade.
Figure 5:
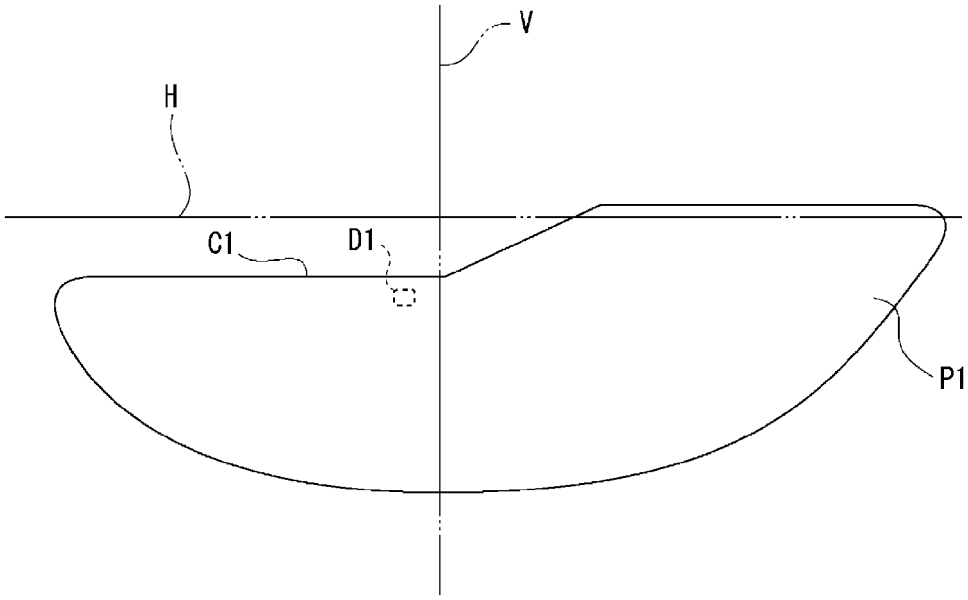
FIG. 5 is a conceptual view illustrating a light distribution pattern.

The shade 12 is constituted by a base member 13 and a plate-shaped member 14, which are made of a metal material, and the plate-shaped member 14 is attached to the base member 13 (see FIGS. 2 to 4). When a reference line extending in a front-rear direction of the vehicle is set as a reference line S, the shade 12 is disposed in a state of being tilted backward and downward with respect to the reference line S.

The base member 13 is formed by bending a plate-shaped member in a predetermined shape, and includes a base surface portion 15 formed in a substantially rectangular shape facing in a substantially front-rear direction and horizontally long, a functional surface portion 16 bent forward from an upper edge of the base surface portion 15, side surface portions 17 and 17 bent forward from both left and right side edges of the base surface portion 15, respectively, attached surface portions 18 and 18 bent laterally (outwardly) from lower edges of the side surface portions 17 and 17, respectively. The functional surface portion 16 is formed in a flat-plate shaped facing in a substantially vertical direction, and a front edge thereof is formed as a cut line forming portion 19 that forms a cut line of a light distribution pattern. A stepped portion 19*a* configured to form a central portion of the cut line in the left-right direction is formed at the central portion of the cut line forming portion 19 in the left-right direction.

At least a part of an upper surface of the functional surface portion 16 is formed as a reflective surface 16*a*. The reflective surface 16*a* is formed by, for example, depositing aluminum on a part of the functional surface portion 16.

The plate-shaped member 14 is formed in a flat plate-shaped facing in a substantially front-rear direction, and an upper end portion is provided as a dimming portion 14*a* including an upwardly convex portion, and a portion other than the dimming portion 14*a* is provided as an attached portion 14*b*. Therefore, the dimming portion 14*a* is also formed in a flat plate-shaped. However, the dimming portion 14*a* may be formed in a shape bent with respect to the attached portion 14*b*.

The attached portion 14*b* of the plate-shaped member 14 is attached to a rear surface of the base surface portion 15 by, for example, welding or bonding. Therefore, the dimming portion 14*a* is positioned above the base surface portion 15. Meanwhile, the dimming portion 14*a* may be integrally formed with the base surface portion 15 or the functional surface portion 16.

As described above, in the shade 12, both the functional surface portion 16 including the cut line forming portion 19 and the plate-shaped member 14 including the dimming portion 14*a* are formed in a flat plate-shaped. The attached surface portions 18 and 18 of the shade 12 are attached to an attaching member such as a bracket.

As described above, the shade 12 is disposed in a state of being tilted backward and downward with respect to the reference line S, and a tilted angle θ with respect to the reference line S is, for example, 14 degrees to 24 degrees. However, the tilted angle θ of the shade 12 with respect to the reference line S is determined according to the diameter of the projection lens 8, the position of the rear focal point of the projection lens 8, or each position of the two focal points of the reflector 10, and may be set to an angle other than 14 degrees to 24 degrees.

In the vehicle headlamp 1 configured as described above, when light is emitted from the light source 11, the emitted light is reflected by the reflective surface 10*a* of the reflector 10 toward the projection lens 8, is converted into substantially parallel light by the projection lens 8, is transmitted through the cover 3, and is irradiated to the front. At this time, a part of the light reflected by the reflective surface 10*a* of the reflector 10 is shielded by the shade 12, and a light distribution pattern P1 is formed (see FIG. 5). Meanwhile, in FIG. 5, a horizontal line H and a vertical line V are illustrated.

An upper edge of the light distribution pattern P1 is a cut line C1, and the cut line C1 is formed by the cut line forming portion 19 of the shade 12. At this time, a part of the light emitted from the light source 11 is controlled (shielded) by the dimming portion 14*a* and the cut line forming portion 19, and thus, a low-brightness portion D1 is formed in the light distribution pattern P1 at a position in the vicinity of the cut line C1 (a portion indicated by a broken line in FIG. 5).

The low-brightness portion D1 is a portion of the light distribution pattern P1 having a lower brightness than that of other portions. By forming the low-brightness portion D1 in the light distribution pattern P1, the generation of dazzling light (glare light) to passengers of a preceding vehicle or an oncoming vehicle is suppressed.

Further, a part of the light emitted from the light source 11 and reflected by the reflector 10 is reflected by the reflective surface 16*a* formed in the functional surface portion 16 of the shade 12, is transmitted through the projection lens 8 and the cover 3, and is irradiated to the front. Therefore, among the light emitted from the light source 11, in addition to the light that is not shielded by the shade 12, the light reflected by the reflective surface 16*a* of the functional surface portion 16 is also used as a part of light that forms the light distribution pattern P1.

In this manner, in the vehicle headlamp 1, at least a part of the functional surface portion 16 of the shade 12 is formed as the reflective surface 16*a* that reflects the light emitted from the light source 11, and the light reflected by the reflective surface 16*a* is used as a part of the light that forms the light distribution pattern P1.

Therefore, since at least a part of the functional surface portion 16 serves as the reflective surface 16*a* that reflects the light that forms the light distribution pattern P1, the utilization efficiency of the light emitted from the light source 11 may be improved.

As described above, in the vehicle headlamp 1, a predetermined end edge of the shade 12 serves as the cut line forming portion 19 that forms the cut line C1 of the light distribution pattern P1, the shade 12 is provided with the dimming portion 14*a* positioned behind the cut line forming portion 19, the low-brightness portion D1 having a lower brightness than that of other portions is formed in a part of the light distribution pattern P1 by the cut line forming portion 19 and the dimming portion 14*a*, and at least the functional surface portion 16 is tilted backward and downward.

Therefore, since the flat plate-shaped functional surface portion 16 including the cut line forming portion 19 is tilted backward and downward, the cut line C1 of the light distribution pattern P1 is formed by the cut line forming portion 19 and the low-brightness portion D1 is formed by the cut line forming portion 19 and the dimming portion 14*a*. As a result, the bending processing for forming the cut line forming portion 19 is not required at the manufacturing of the shade 12, and it is possible to secure a high positional accuracy of the cut line forming portion 19 with respect to the entire shade 12 and to promote a decrease of the manufacturing cost of the vehicle headlamp 1.

In particular, by performing a punching processing on a metal material, the cut line forming portion 19 may be formed without the bending processing. Therefore, a high positional accuracy of the cut line forming portion 19 may be secured, and then, the vehicle headlamp 1 may be easily manufactured.

Further, the shade 12 is provided with the dimming portion 14*a* positioned behind the cut line forming portion 19 and forming the low-brightness portion D1 having a lower brightness than that of other portions in a part of the light distribution pattern P1, and the dimming portion 14*a* is formed in a flat plate-shaped.

Therefore, since the low-brightness portion D1 is formed in the light distribution pattern P1 by the dimming portion 14*a*, the configuration of the portion that forms the low-brightness portion D1 may be simplified, the manufacturing cost may be decreased, and the appropriate light distribution pattern P1 may be formed.

Further, the shade 12 is constituted by the base member 13 including the functional surface portion 16 and the plate-shaped member 14 including the dimming portion 14*a* and attached to the base member 13.

Therefore, since the shade 12 is constituted by two members of the base member 13 and the plate-shaped member 14, the high functionality of the shade 12 may be secured, and then, the configuration may be simplified.

Further, the base member 13 is provided with the base surface portion 15 bent with respect to the functional surface portion 16, and the plate-shaped member 14 is attached to the base surface portion 15.

Therefore, since the plate-shaped member 14 including the dimming portion 14*a* is attached to the base surface portion 15 integrally formed with the functional surface portion 16 including the cut line forming portion 19 and provided continuously with the functional surface portion 16, the positional accuracy between the cut line forming portion 19 and the plate-shaped member 14 may be improved.

Vehicle Headlamp According to Second Embodiment

Next, a vehicle headlamp 51 according to a second embodiment will be described (see FIGS. 6 to 12).

Meanwhile, the vehicle headlamp 51 described below is only different in that a shade 52 is used instead of the shade 12, as compared with the vehicle headlamp 1 described above. Therefore, only the parts different from the vehicle headlamp 1 will be described in detail, and the other parts will be designated by the same reference numerals as those designated to the same parts of the vehicle headlamp 1, and the description thereof will be omitted.

Figure 6:
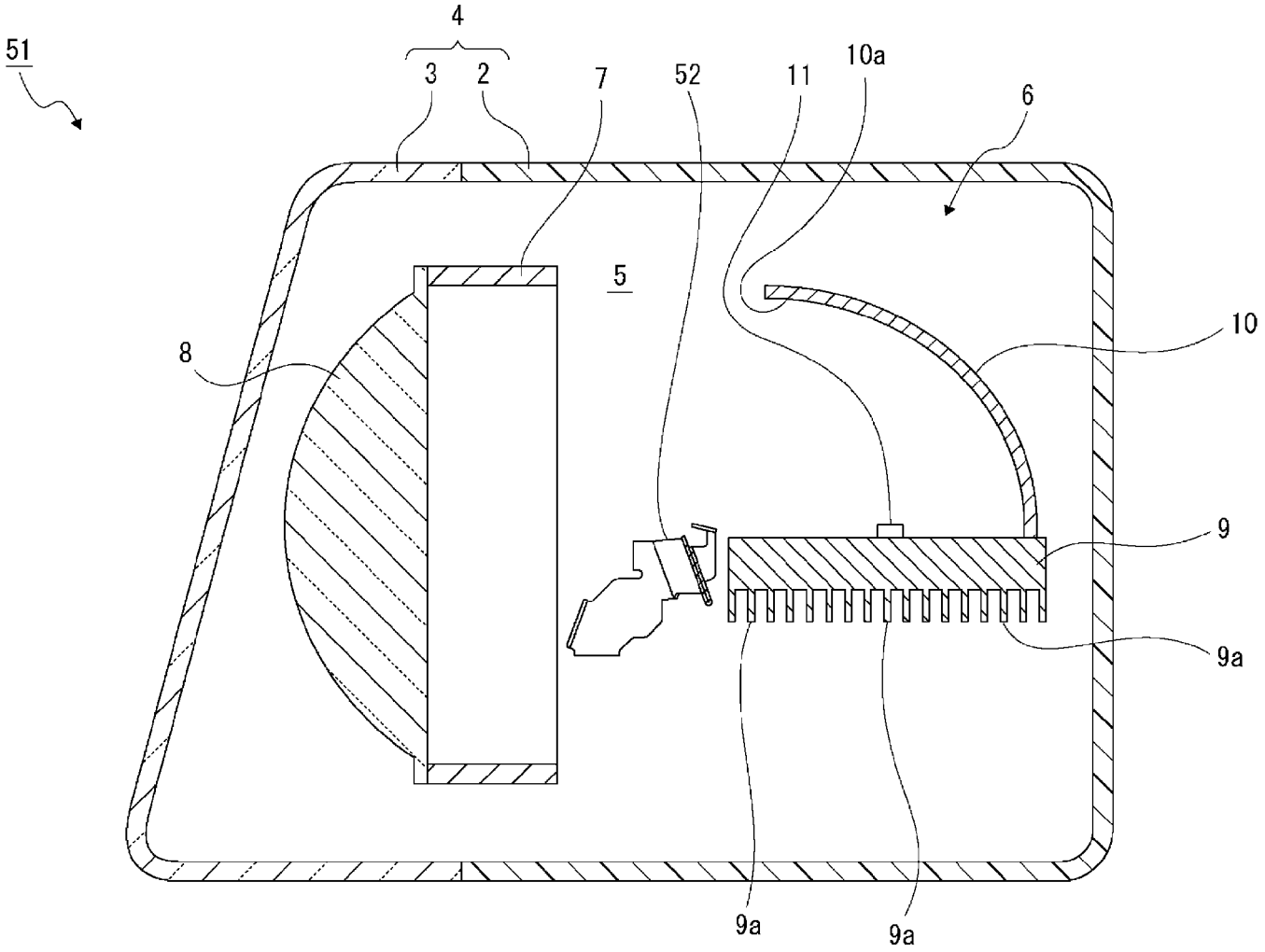
FIG. 6 illustrates an embodiment of a vehicle headlamp of the present disclosure together with FIGS. 7 to 12, and is a schematic cross-sectional view of the vehicle headlamp.

The shade 52 is, for example, a fixed shade, and is attached to a part of the lamp unit 6, for example, an attaching member such as a bracket (not illustrated) (see FIG. 6). However, the shade 52 may be provided as a movable shade.

Figure 7:
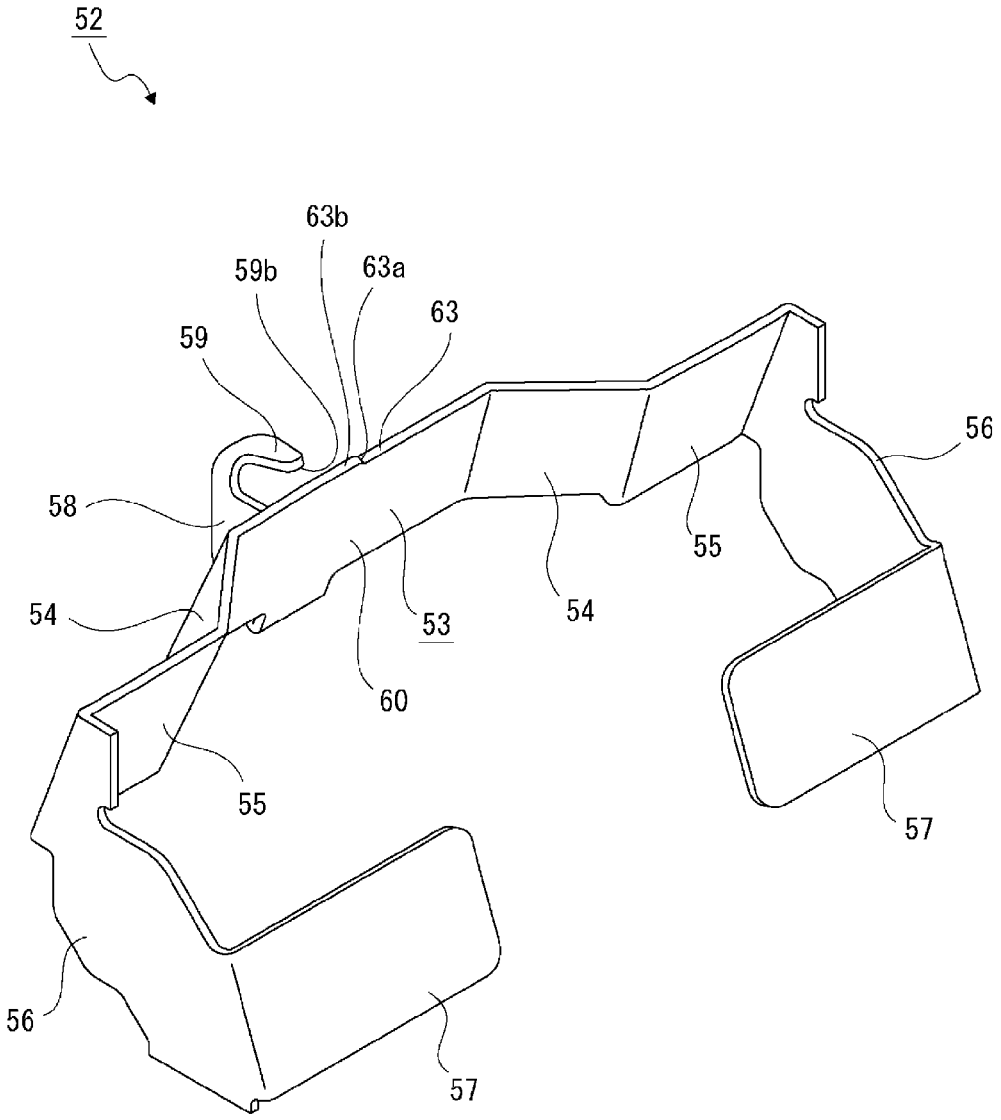
FIG. 7 is a perspective view of a shade.
Figure 8:
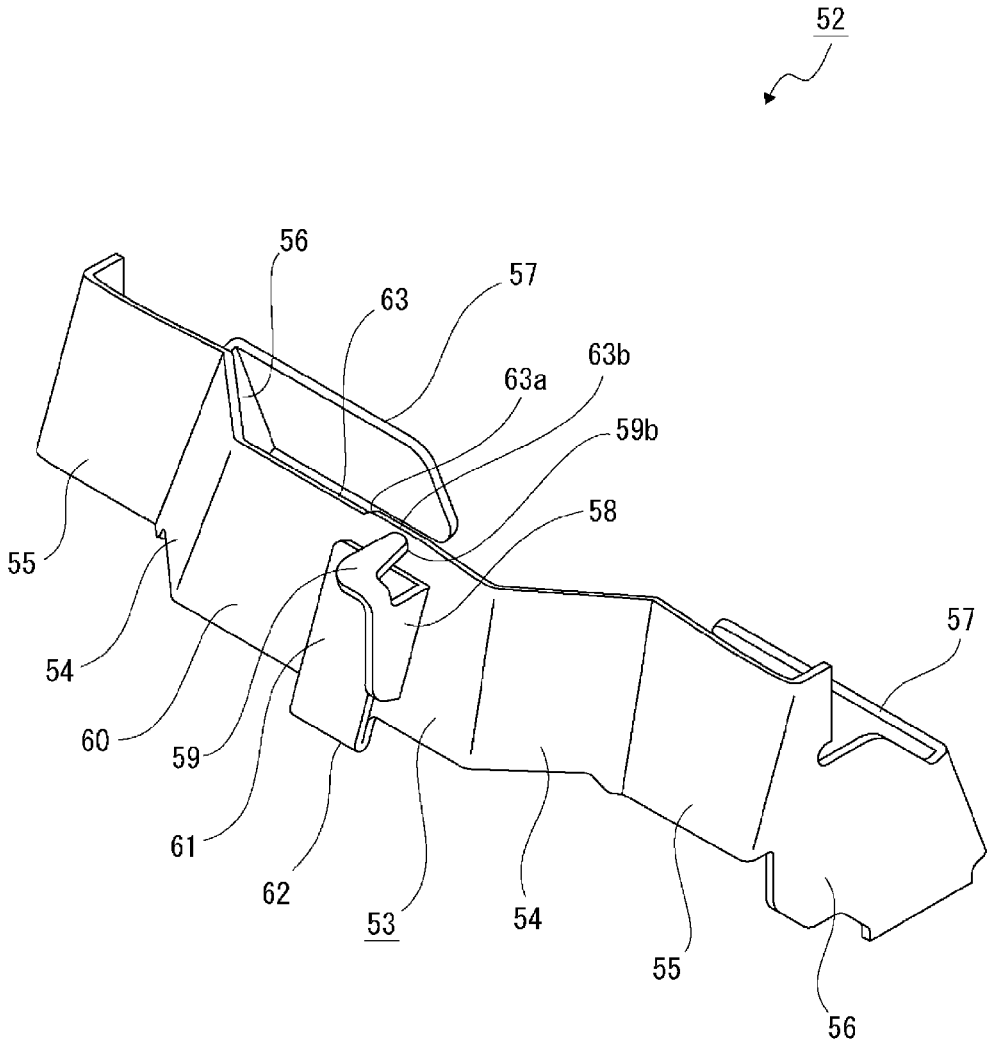
FIG. 8 is a perspective view illustrating the shade when viewed from a direction different from that in FIG. 7.
Figure 9:
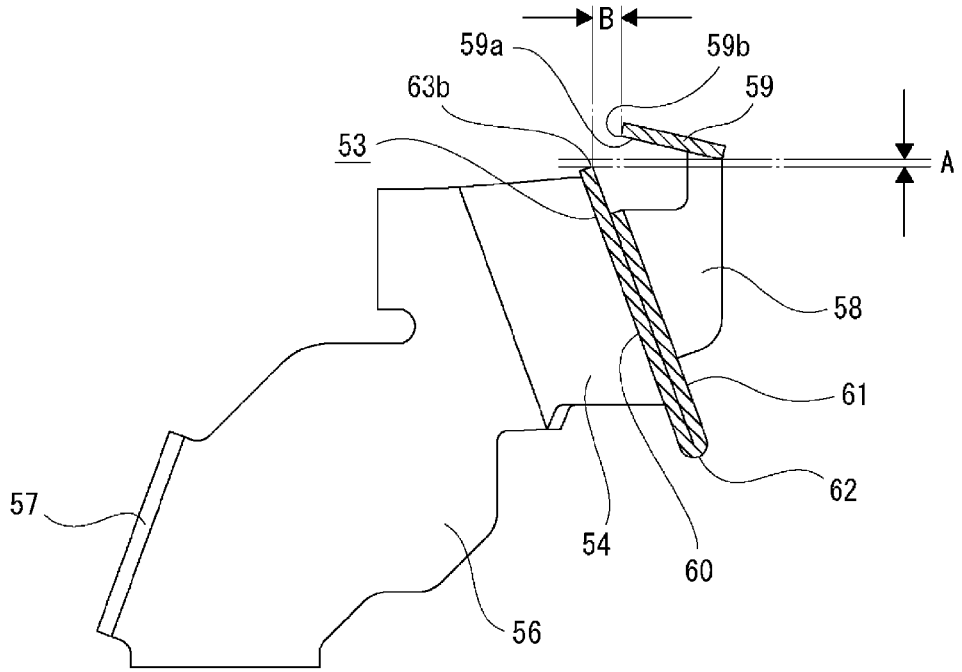
FIG. 9 is a vertical cross-sectional view of the shade.

Each part of the shade 52 is integrally formed by a metal material (see FIGS. 7 to 9). The shade 52 includes a functional surface portion 53, tilted surface portions 54 and 54, end surface portions 55 and 55, side surface portions 56 and 56, attached surface portions 57 and 57, a connecting portion 58, and a dimming portion 59.

The functional surface portion 53 includes a first portion 60 formed in a folded shape at a lower end portion and formed in a substantially rectangular flat plate-shaped facing in a substantially front-rear direction and horizontally long, and a second portion 61 formed in a substantially rectangular flat plate-shaped facing in a substantially front-rear direction and vertically long. The folded portion is provided as a folded portion 62.

The first portion 60 is slightly tilted forward with respect to the vertical direction, and an upper edge thereof is formed as a cut line forming portion 63 that forms a cut line of a light distribution pattern. A stepped portion 63*a* configured to form a central portion of the cut line in the left-right direction is formed at the central portion of the cut line forming portion 63 in the left-right direction.

The second portion 61 is continuous with the central portion of the first portion 60 in the left-right direction via the folded portion 62, and a width thereof in the left-right direction is set to be smaller than a width of the first portion 60. The second portion 61 is positioned behind the first portion 60, and a front surface thereof is in contact with a rear surface of the first portion 60. Therefore, the second portion 61 is also slightly tilted forward and downward with respect to the vertical direction in the same manner as the first portion 60.

The tilted surface portions 54 and 54 are bent forward from the left and right side edges of the functional surface portion 53, respectively, and are tilted so as to be displaced forward as they go laterally from the functional surface portion 53. The end surface portions 55 and 55 are bent backward from the laterally outer end edges of the tilted surface portions 54 and 54, respectively, and are positioned facing in a substantially front-rear direction. The side surface portions 56 and 56 are bent forward from the laterally outer end edges of the end surface portions 55 and 55, respectively, and are positioned facing in a substantially left-right direction. The attached surface portions 57 and 57 are laterally bent in a direction toward each other from the front edges of the side surface portions 56 and 56.

The connecting portion 58 is bent backward from a part of a side edge on one side of the second portion 61, and protrudes backward from the second portion 61 to be positioned facing in a substantially left-right direction.

The dimming portion 59 is laterally bent from a part of an upper edge of the connecting portion 58, the thickness direction is in a substantially vertical direction, and the dimming portion 59 is slightly tilted forward and upward. The dimming portion 59 is formed in a shape extending in the front-rear direction, and a rear end portion thereof is continuous with the connecting portion 58.

Figure 10:
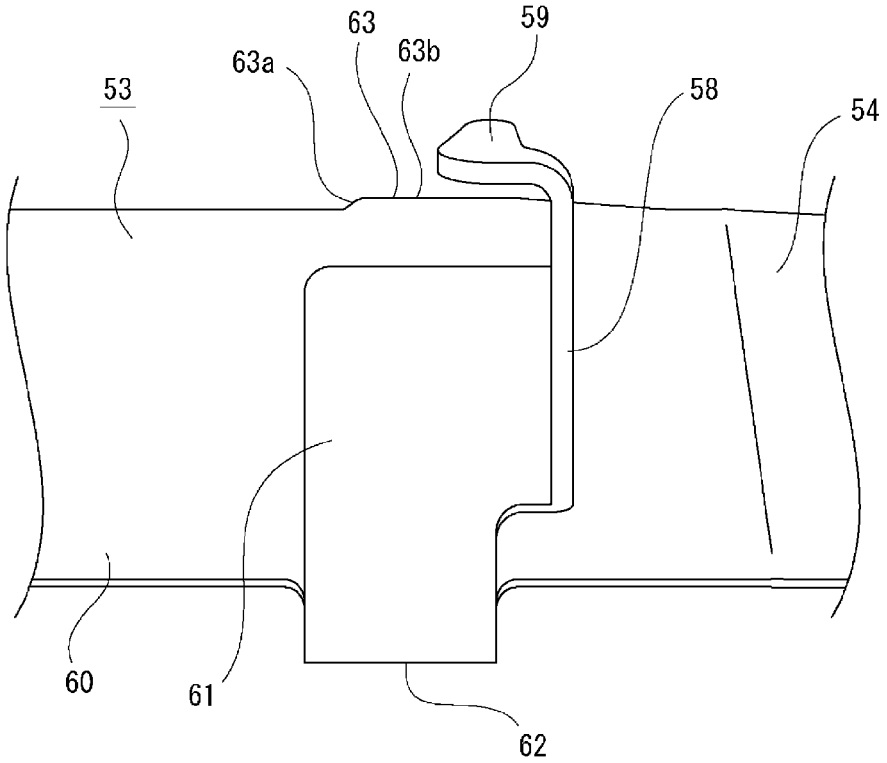
FIG. 10 is a rear view illustrating a part of the shade.

The dimming portion 59 is positioned behind the cut line forming portion 63, and a lower surface 59*a* thereof is positioned above an upper end 63*b* of the cut line forming portion 63 (see FIGS. 9 and 10). The lower surface 59*a* of the dimming portion 59 is positioned above the upper end 63*b* of the cut line forming portion 63, and a gap A is formed between the lower surface 59*a* and the upper end 63*b*. Further, the dimming portion 59 is positioned behind the cut line forming portion 63, and a gap B is formed between a front end 59*b* of the dimming portion 59 and the upper end 63*b*. Meanwhile, at least a part of the lower surface 59*a* of the dimming portion 59 may be positioned above the upper end 63*b* of the cut line forming portion 63.

In the shade 52, the attached surface portions 57 and 57 are attached to an attaching member such as a bracket.

In the vehicle headlamp 51 configured as described above, when light is emitted from the light source 11, the emitted light is reflected by the reflective surface 10*a* of the reflector 10 toward the projection lens 8, is converted into substantially parallel light by the projection lens 8, is transmitted through the cover 3, and is irradiated to the front. At this time, a part of the light reflected by the reflective surface 10*a* of the reflector 10 is shielded by the shade 52, and a light distribution pattern P2 is formed (see FIG. 11). Meanwhile, in FIG. 11, a horizontal line H and a vertical line V are illustrated.

An upper edge of the light distribution pattern P2 is a cut line C2, and the cut line C2 is formed by the cut line forming portion 63 of the shade 52. At this time, a part of the light emitted from the light source 11 is controlled (shielded) by the dimming portion 59, and thus, a low-brightness portion D2 is formed in the light distribution pattern P2 at a position in the vicinity of the cut line C2 (a portion indicated by a broken line in FIG. 11).

The low-brightness portion D2 is a portion of the light distribution pattern P2 having a lower brightness than that of other portions. By forming the low-brightness portion D2 in the light distribution pattern P2, the generation of dazzling light (glare light) to passengers of a preceding vehicle or an oncoming vehicle is suppressed.

However, in the vehicle headlamp disclosed in Patent Document 1, there is a case where the low-brightness portion having a lower brightness than that of other portions is formed in the light distribution pattern. In this case, the light emitted from the light source is controlled by the dimming portion provided in the shade and the low-brightness portion is formed. By forming the low-brightness portion in the light distribution pattern, the generation of dazzling light (glare light) to passengers of a preceding vehicle or an oncoming vehicle is suppressed.

In Patent Document 1, a rear extending portion 123b positioned behind a front extending portion 123a that forms the cut line is provided as the dimming portion that forms the low-brightness portion, and the rear extending portion is provided as an upper end portion of an extending portion 121a1 closely in contact with a rear surface of a rear surface wall 121a (see FIG. 6 of Patent Document 1).

However, in the configuration disclosed in Patent Document 1, the front extending portion that forms the cut line of the light distribution pattern and the rear extending portion that forms the low-brightness portion in the light distribution pattern are overlapped with each other in the front-rear direction when viewed from the front. Therefore, the brightness of the portion of the light distribution pattern where dimming is not originally required is decreased, and the brightness of the portion around the portion that is originally formed as the low-brightness portion is also decreased, and thus, the visibility of the driver of the vehicle may be decreased.

Therefore, as described above, in the vehicle headlamp 51, a predetermined end edge of the shade 52 serves as the cut line forming portion 63 that forms the cut line C2 of the light distribution pattern P2, the shade 52 is provided with the dimming portion 59 that forms the low-brightness portion D2 having a lower brightness than that of other portions in a part of the light distribution pattern P2, and the lower surface 59*a* of the dimming portion 59 is positioned above the upper end 63*b* of the cut line forming portion 63.

Therefore, since the dimming portion 59 is positioned above the cut line forming portion 63 with the predetermined gap A therebetween, the brightness of the portion of the light distribution pattern P2 around the area formed as the low-brightness portion D2 is not decreased. Since only the brightness of the required area of the light distribution pattern P2 is decreased, the generation of dazzling light may be suppressed, and then, the visibility of the driver of the vehicle may be improved.

Figure 11:
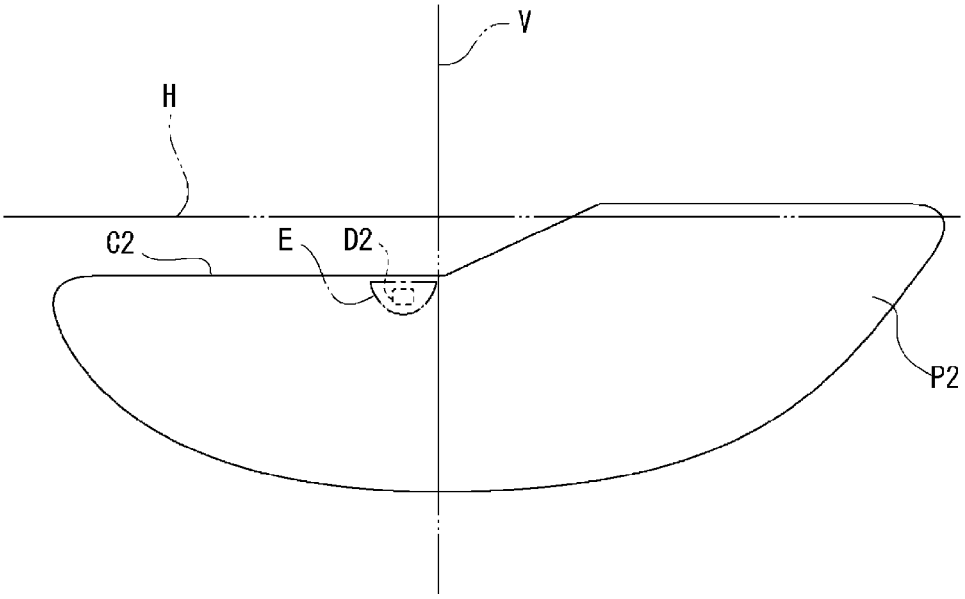
FIG. 11 is a conceptual view illustrating a light distribution pattern.
Figure 12:
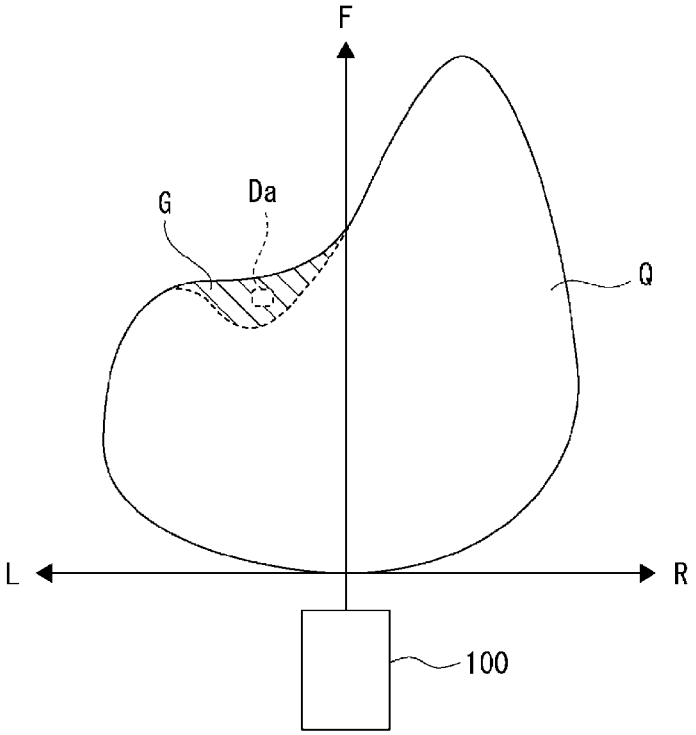
FIG. 12 is a conceptual view illustrating an irradiation pattern.

Specifically, in a case of the vehicle headlamp in the related art in which the dimming portion is not positioned above the cut line forming portion with a gap therebetween and the dimming portion and the cut line forming portion are overlapped with each other in the front-rear direction when viewed from the front, as illustrated in FIG. 11, the brightness of a portion E surrounded by an alternate long and short dash line becomes lower than that of other portions, and thus, the brightness of the portion of the light distribution pattern P2 where dimming is not originally required is also decreased. Therefore, as illustrated in FIG. 12, in an irradiation pattern Q of a vehicle 100 to the road surface, an area G indicated by diagonal lines where light is not irradiated is formed, which causes a decrease in visibility of the driver of the vehicle 100. Meanwhile, in FIG. 12, a front direction F, which is a traveling direction of the vehicle 100, and a left and right direction LR are illustrated.

Meanwhile, in the case of the vehicle headlamp 51 in which the dimming portion 59 is positioned above the cut line forming portion 63 with the gap A therebetween, as illustrated in FIG. 11, the brightness of only the low-brightness portion D2 surrounded by a broken line becomes lower than that of other portions, and the brightness of only the portion of the light distribution pattern P2 where dimming is originally required is decreased. Therefore, as illustrated in FIG. 12, the portion surrounded by a solid line except a portion Da corresponding to the low-brightness portion D2 is formed as the irradiation pattern Q of the vehicle 100 to the road surface, and the visibility of the driver of the vehicle 100 may be improved.

Further, in the vehicle headlamp 51, the portion of the shade 52 including the cut line forming portion 63 is provided as the flat plate-shaped functional surface portion 53, the shade 52 is provided with the connecting portion 58 having one end continuous with the functional surface portion 53, the dimming portion 59 is continuously provided at the other end of the connecting portion 58, and the connecting portion 58 is formed in a shape protrudes from the functional surface portion 53.

Therefore, since the position of the dimming portion 59 with respect to the cut line forming portion 63 is determined according to the protruding amount and the protruding direction of the connecting portion 58 with respect to the functional surface portion 53 including the cut line forming portion 63, an appropriate position of the dimming portion 59 with respect to the cut line forming portion 63 is easily set, and the low-brightness portion D2 having a size required for a predetermined range of the light distribution pattern P2 may be easily formed.

Further, the dimming portion 59 is formed by being bent with respect to the connecting portion 58.

Therefore, since the direction of the dimming portion 59 with respect to the cut line forming portion 63 is determined according to the bending angle of the dimming portion 59 with respect to the connecting portion 58, an appropriate direction of the dimming portion 59 with respect to the cut line forming portion 63 is easily set, and the low-brightness portion D2 having a size required for a predetermined range of the light distribution pattern P2 may be easily formed.

Further, the functional surface portion 53 is formed in a folded shape, the portions on both sides of the folded portion 62 of the functional surface portion 53 are provided as the first portion 60 and the second portion 61, respectively, the first portion 60 and the second portion 61 are in contact with each other in the thickness direction, the cut line forming portion 63 is formed in the first portion 60, and the connecting portion 58 protrudes from the second portion 61.

Therefore, since the first portion 60 including the cut line forming portion 63 and the second portion 61 from which the connecting portion 58 protrudes are in contact with each other in the thickness direction, the positional accuracy of the connecting portion 58 with respect to the cut line forming portion 63 is increased, and a high positional accuracy of the dimming portion 59 continuous with the connecting portion 58 with respect to the cut line forming portion 63 may be secured.

Additionally, the entire shade 52 is integrally formed, and in particular, since the functional surface portion 53, the connecting portion 58, and the dimming portion 59 are integrally formed, the functional surface portion 53, the connecting portion 58, and the dimming portion 59 are formed by one member, and thus, the number of parts of the shade 52 may be reduced.

DESCRIPTION OF SYMBOLS

1: vehicle headlamp
11: light source
12: shade
13: base member
14: plate-shaped member
14*a*: dimming portion
15: base surface portion
16: functional surface portion
16*a*: reflective surface
19: cut line forming portion
P1: light distribution pattern
C1: cut line
D1: low-brightness portion
51: vehicle headlamp
52: shade
53: functional surface portion
58: connecting portion
59 dimming portion
59*a*: lower surface
60: first portion
61: second portion
62: folded portion
63: cut line forming portion
63*b*: upper end
P2: light distribution pattern
C2: cut line
D2: low-brightness portion

What is claimed is:

1. A vehicle headlamp comprising:
a shade configured to shield a part of light emitted from a light source,
wherein a predetermined end edge of the shade serves as a cut line forming plate that forms a cut line in a light distribution pattern,
the shade is provided with a dimming plate positioned behind the cut line forming plate,
the cut line forming plate and the dimming plate form a low-brightness portion having a lower brightness than that of other portions in a part of the light distribution pattern,
a portion of the shade including the cut line forming plate is provided as a functional surface having a flat plate shape, and
at least the functional surface including the cut line forming plate is tilted backward and downward, and the dimming plate protrudes upwardly with respect to the functional surface.

2. The vehicle headlamp according to claim 1, wherein the dimming plate is formed in a flat plate shape.

3. The vehicle headlamp according to claim 2, wherein the shade is constituted by a base including the functional surface and a plate including the dimming plate and attached to the base.

4. The vehicle headlamp according to claim 3, wherein the base is provided with a base surface that is bent with respect to the functional surface, and the plate is attached to the base surface.

5. The vehicle headlamp according to claim 1, wherein at least a part of the functional surface is formed as a reflective surface that reflects the light emitted from the light source, and
the light reflected by the reflective surface is used as a part of light that forms the light distribution pattern.

6. The vehicle headlamp according to claim 1, wherein a front end of the functional surface serves as the cut line forming plate.

7. A vehicle headlamp comprising:
a shade configured to shield a part of light emitted from a light source,
wherein a predetermined end edge of the shade serves as a cut line forming plate that forms a cut line of a light distribution pattern,
the shade is provided with a dimming plate that forms a low-brightness portion having a lower brightness than that of other portions in a part of the light distribution pattern, and
a lower surface of the dimming plate is positioned above an upper end of the cut line forming plate.

8. The vehicle headlamp according to claim 7, wherein a portion of the shade including the cut line forming plate is provided as a functional surface having a flat plate shape,
the shade is provided with a connector having one end continuous with the functional surface,
the dimming plate is continuously provided at a remaining end of the connector, and
the connector is formed in a shape protruding from the functional surface.

9. The vehicle headlamp according to claim 8, wherein the dimming plate bent with respect to the connector.

10. The vehicle headlamp according to claim 8, wherein the functional surface is formed in a folded shape,
both sides of a folded portion of the functional surface are provided as a first portion and a second portion, respectively,
the first portion and the second portion are in contact with each other in a thickness direction,
the cut line forming plate is formed in the first portion, and
the connector protrudes from the second portion.

11. The vehicle headlamp according to claim 8, wherein the functional surface, the connector, and the dimming plate are integrally formed.

* * * * *